US007365261B2

(12) United States Patent
Hirano

(10) Patent No.: US 7,365,261 B2
(45) Date of Patent: Apr. 29, 2008

(54) MUSICAL PERFORMANCE DATA CREATING APPARATUS WITH VISUAL ZOOMING ASSISTANCE

(75) Inventor: Masashi Hirano, Hamamatsu (JP)

(73) Assignee: Yamaha Corporation (JP)

( * ) Notice: Subject to any disclaimer, the term of this patent is extended or adjusted under 35 U.S.C. 154(b) by 406 days.

(21) Appl. No.: 11/116,911

(22) Filed: Apr. 28, 2005

(65) Prior Publication Data

US 2005/0241462 A1 Nov. 3, 2005

(30) Foreign Application Priority Data

Apr. 28, 2004 (JP) ..... 2004-134897

(51) Int. Cl.
*G10H 1/00* (2006.01)

(52) U.S. Cl. ..... 84/600; 84/470 R; 84/471 R; 84/477 R

(58) Field of Classification Search ..... 84/600, 84/470 R, 471 R, 477 R; 434/307 A
See application file for complete search history.

(56) References Cited

U.S. PATENT DOCUMENTS 4,980,840 A * 12/1990 Yin et al. ..... 715/538
5,604,322 A * 2/1997 Kikuchi ..... 84/477 R
5,703,624 A * 12/1997 van Kruistum ..... 345/169
5,825,905 A * 10/1998 Kikuchi ..... 382/113
5,883,970 A * 3/1999 Kikuchi ..... 382/113
6,066,791 A * 5/2000 Renard et al. ..... 84/477 R
6,281,420 B1 * 8/2001 Suzuki et al. ..... 84/477 R
6,348,648 B1 * 2/2002 Connick, Jr. ..... 84/477 R
6,380,471 B2 * 4/2002 Matsumoto ..... 84/477 R
6,392,132 B2 * 5/2002 Uehara ..... 84/477 R
6,515,210 B2 * 2/2003 Shibukawa ..... 84/477 R
6,515,211 B2 * 2/2003 Umezawa et al. ..... 84/477 R
6,541,687 B1 * 4/2003 Miyamoto ..... 84/477 R
6,727,418 B2 * 4/2004 Matsumoto ..... 84/477 R (Continued)

FOREIGN PATENT DOCUMENTS

JP 4-10637 Y2 3/1992

(Continued)

*Primary Examiner*—Lincoln Donovan
*Assistant Examiner*—Christina Russell
(74) *Attorney, Agent, or Firm*—Rossi, Kimms & McDowell, LLP

(57) ABSTRACT

In an apparatus for creating musical performance data according to operations of a user, a screen display section displays an input screen having a data input area for use in inputting of musical performance data. A position indication section operates when a first operation is taken by the user for indicating a desired position on the data input area. A display enlargement section operates when a second operation is taken eventually by the user for enlarging a local portion of the data input area around the indicated position and displaying the enlarged local portion over the data input area, thereby allowing the user to take a supplemental first operation on the enlarged local portion more easily than the first operation such that the position indication section responds to the supplemental first operation for indicating a desired position on the enlarged local portion of the data input area. A data input section is responsive to a third operation of the user for inputting musical performance data corresponding to the position indicated by the first operation when the supplemental first operation is not taken by the user, or corresponding to the position indicated by the supplemental first operation when the supplemental first operation is taken by the user.

4 Claims, 4 Drawing Sheets

U.S. PATENT DOCUMENTS

| | | | | |
|---|---|---|---|---|
| 6,751,439 | B2 * | 6/2004 | Tice et al. | 434/350 |
| 7,045,698 | B2 * | 5/2006 | Miyamoto | 84/477 R |
| 7,074,999 | B2 * | 7/2006 | Sitrick et al. | 84/477 R |
| 7,239,320 | B1 * | 7/2007 | Hall et al. | 345/473 |
| 2001/0023633 | A1 * | 9/2001 | Matsumoto | 84/478 |
| 2002/0134224 | A1 * | 9/2002 | Umezawa et al. | 89/1.1 |
| 2003/0005814 | A1 * | 1/2003 | Matsumoto | 84/477 R |
| 2004/0055441 | A1 * | 3/2004 | Katsuta | 84/470 R |
| 2004/0070621 | A1 * | 4/2004 | Suzuki et al. | 345/764 |
| 2004/0112201 | A1 * | 6/2004 | Funaki | 84/477 R |
| 2004/0252119 | A1 * | 12/2004 | Hunleth et al. | 345/440 |

FOREIGN PATENT DOCUMENTS

| | | |
|---|---|---|
| JP | 2580720 B2 | 11/1996 |

* cited by examiner

FIG.2 (1)
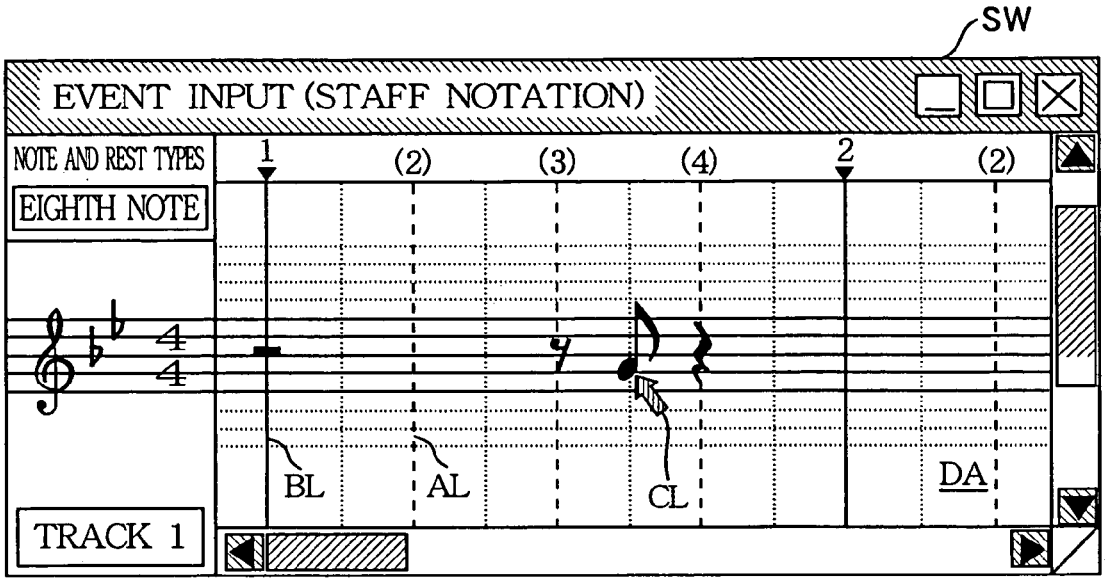
FIG.2 (2)
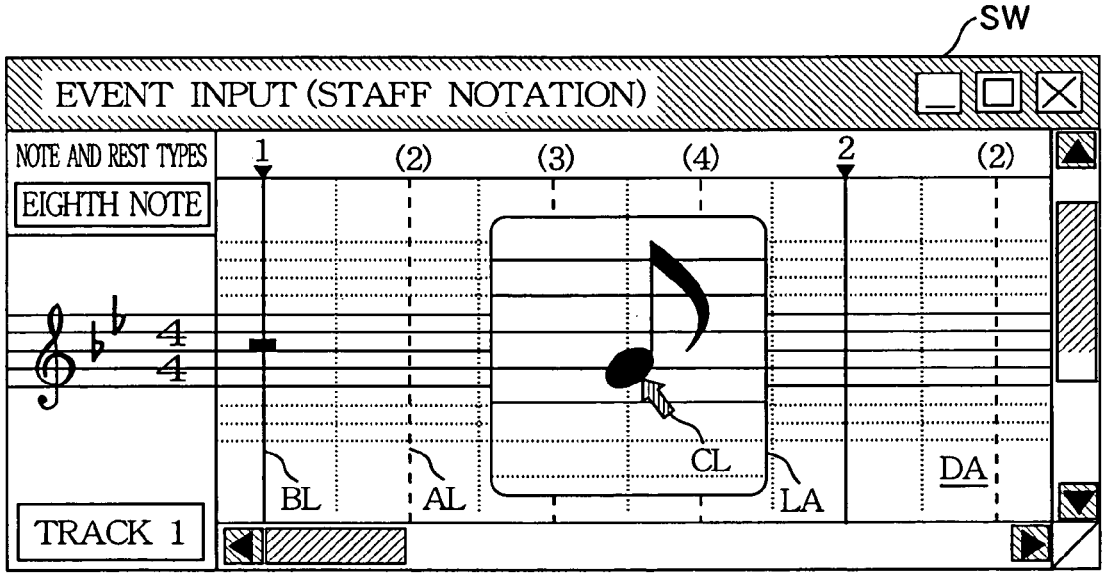

FIG.3 (1)
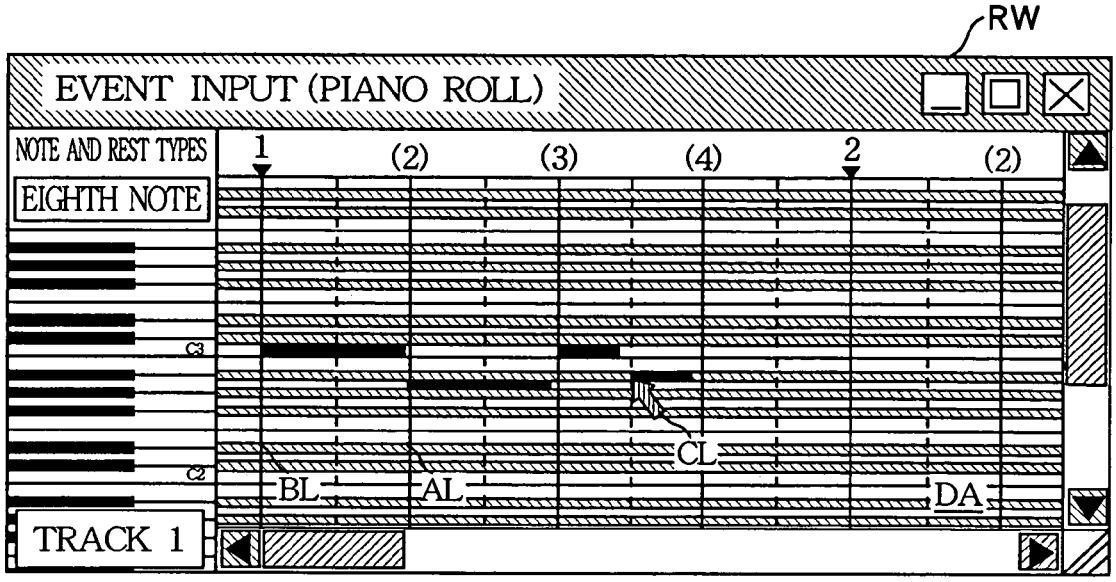
FIG.3 (2)
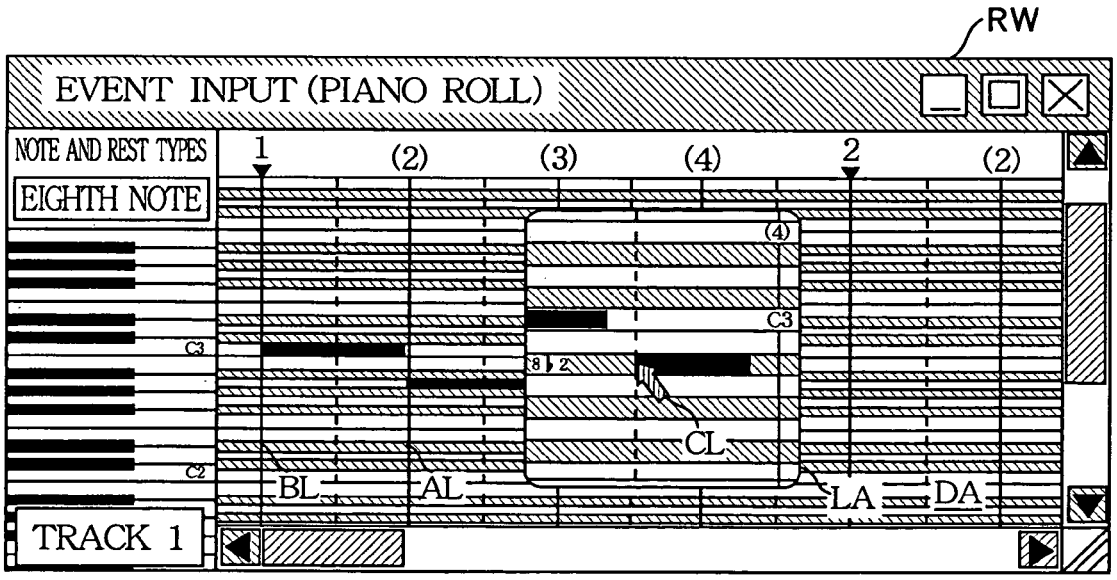

MUSICAL PERFORMANCE DATA CREATING APPARATUS WITH VISUAL ZOOMING ASSISTANCE

BACKGROUND OF THE INVENTION

1. Technical Field

The present invention relates to a musical performance data creation system for creating or editing musical performance data with the visual assistance of a display.

2. Related Art

Conventionally, a display device is used to display a screen of music score (staff notation) or piano roll so that musical performance data can be created or edited with the assistance of the screen display. For example, this method is described in Japanese Utility Model Publication No. 4-10637 and Patent Publication No. 2580720 as follows.

A pointing device is used to, for example, click at a position corresponding to a specified pitch and a specified timing on a score (staff notation) screen or a piano roll screen that is displayed. In this manner, a musical note is pasted at that position.

However, there may be a narrow interval equivalent to a semitone along the pitch direction depending on the display resolution, the pointing device resolution, or the GUI (Graphical User Interface) display mode. The pointing device needs to be operated carefully to precisely input a pitch. A musical note may be sometimes inadvertently entered with a semitone or a whole tone deviated from an intended pitch.

SUMMARY OF THE INVENTION

The present invention has been made in consideration of the foregoing. It is therefore an object of the present invention to provide a musical performance data creation system capable of accurately entering musical performance data at a target position by using a data input screen which can zoom up the vicinity of a data input position as needed.

According to a major aspect of the present invention, there is provided an apparatus for creating musical performance data according to operations of a user. The inventive apparatus comprises a screen display section that displays an input screen having a data input area for use in inputting of musical performance data; a position indication section operable when a first operation is taken by the user for indicating a position on the data input area; a display enlargement section operable when a second operation is taken eventually by the user for enlarging a local portion of the data input area around the indicated position and displaying the enlarged local portion over the data input area, thereby allowing the user to take a supplemental first operation on the enlarged local portion more easily than the first operation such that the position indication section responds to the supplemental first operation for indicating a position on the enlarged local portion of the data input area; and a data input section that is responsive to a third operation of the user for inputting musical performance data corresponding to the position indicated according to the first operation when the supplemental first operation is not taken by the user, or corresponding to the position indicated according to the supplemental first operation when the supplemental first operation is eventually taken by the user.

In addition, there is provided a program for use in an apparatus having a processor and a display for creating musical performance data according to operations of a user. The program is executable by the processor for enabling the apparatus to perform a method comprising the steps of: displaying an input screen having a data input area for use in inputting of musical performance data; indicating a position on the data input area when a first operation is taken by the user; enlarging a local portion of the data input area around the indicated position when a second operation is taken by the user; displaying the enlarged local portion over the data input area, thereby allowing the user to take a supplemental first operation on the enlarged local portion more easily than the first operation such that a position is indicated on the enlarged local portion of the data input area according to the supplemental first operation; and responding to a third operation taken by the user for inputting musical performance data corresponding to the position indicated by the first operation when the supplemental first operation is not taken by the user, or corresponding to the position indicated by the supplemental first operation when the supplemental first operation is taken by the user.

Preferably in the musical performance data creation apparatus according to the present invention, the display enlargement section superposes the enlarged local portion over the data input area, such that the position indicated in the enlarged local portion is in alignment with the position indicated in the data input area.

Preferably, the screen display section displays the input screen having the data input area defined by two-dimensional coordinates system, the position indication section indicates the position where a musical note is to be arranged such that a pair of two-dimensional coordinates of the position specify a musical timing and a musical pitch, respectively, of the musical note arranged at the position, and the data input section inputs the musical performance data representing the musical timing and the musical pitch of the musical note.

In this manner, the present invention partially enlarges the vicinity of the pointed position in the data input area correspondingly to the specific operation (second user operation) in a series of the user operations. It is possible to accurately and easily write musical performance data corresponding to a target position.

BRIEF DESCRIPTION OF THE DRAWINGS

FIGS. 2(1) and 2(2) are a diagram showing an example of the event input screen according to the embodiment of the present invention.

FIGS. 3(1) and 3(2) are a diagram showing another example of the event input screen according to the embodiment of the present invention.

DETAILED DESCRIPTION OF THE INVENTION

An embodiment of the present invention will be described in further detail with reference to the accompanying drawings. However, the embodiment is merely an example. Various changes and modifications may be made in the present invention without departing from the spirit and scope thereof.

[System Construction]

Figure 1:
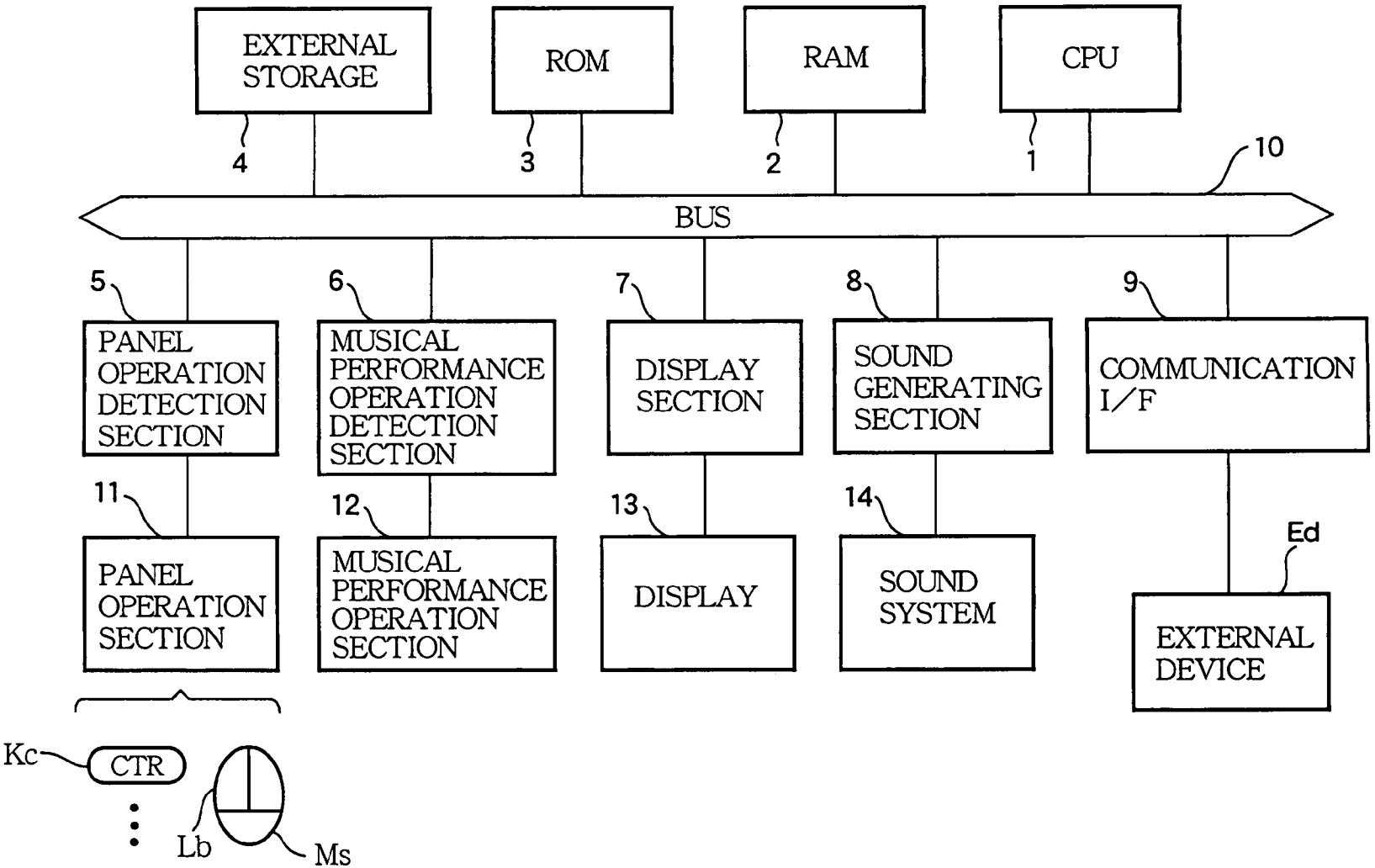
FIG. 1 is a block diagram exemplifying the hardware construction of the musical performance data creation system according to an embodiment of the present invention.

FIG. 1 exemplifies the hardware construction of a musical performance data creation system according to an embodiment of the present invention. In this example, a musical performance data creation apparatus is represented by a general-purpose information processing apparatus (computer) such as a personal computer provided with a musical performance input section and a musical sound output section. Further, it may be preferable to use a music-oriented information processing apparatus (computer) such as an electronic musical instrument. The musical performance data creation apparatus comprises a central processing unit (CPU) 1, random access memory (RAM) 2, read-only memory (ROM) 3, an external storage 4, a panel operation detection section 5, a musical performance operation detection section 6, a display section 7, a sound generating section 8, a communication interface (communication I/F), and the like. These components 1 through 9 are connected to each other via a bus 10.

The CPU 1 controls the entire apparatus and performs various processes according to various control programs. The CPU 1 performs a score input process and the like according to a musical performance data creation program included in the control programs. The RAM 2 functions as a process buffer to temporarily store various information used for these processes. The ROM 3 stores various control programs and data.

The external storage 4 is provided as storage section using storage media such as a hard disk (HD), compact disk read-only memory (CD-ROM), a flexible disk (FD), a magnetic optical (MO) disk, a digital versatile disk (DVD), and a memory card. Not only the ROM 3, but also the external storage 4 can store various programs including the musical performance data creation program and various data. In addition, the external storage 4 can record musical performance data that is created or edited according to the musical performance data creation program.

The ROM 3 may not store control programs such as the musical performance data creation program. In this case, the control programs can be stored in the external storage 4 such as HD and CD-ROM and then can be loaded into the RAM 2. In this manner, the CPU 1 can operate similarly to the case where the ROM 3 stores the control programs. It is possible to easily add or upgrade control programs. Accordingly, the intended musical performance data creation apparatus can be implemented by installing the musical performance data creation program and necessary control parameters.

The panel operation detection section 5 is connected to a panel operation section 11. The panel operation section 11 has panel operation devices (keyboard, mouse, and the like) for turning on or off the power, starting or stopping process operations such as a score input process, and configuring various settings. The panel operation detection section 5 detects the contents of user's panel operations using the panel operation devices. The panel operation detection section 5 supplies the corresponding input information to the system core.

The panel operation devices include, for example, a control (CTR) key Kc to control partially enlarging display (zoom in) and a mouse Ms to move a cursor (CL) and data (musical note) images. Any control key on the keyboard is assigned to the control key Kc during the score input process. A left click button Lb of the mouse Ms is used to enable a type of musical performance data according to the cursor (CL) displayed on the display (13) or to determine a musical performance data's play position.

The musical performance operation detection section 6 is connected to a musical performance operation section 12 having musical performance operation devices such as an instrumental keyboard and a wheel. The musical performance operation detection section 6 detects the contents of user's musical performance operations using the musical performance operation devices and supplies the corresponding input information to the system core. The musical performance operation detection section 6 and the musical performance operation section 12 constitute the musical performance input section.

The display section 7 connects with a display device 13 including display devices such as CRT and LCD, and various lamps and indicators. The display section 7 controls display contents and indication states of the display device 13 in accordance with instructions from the CPU 1. The display section 7 provides visual assistance for user operations on the panel or the musical performance operation sections 11 and 12. Particularly when the score input process creates (and/or edits) musical performance data in accordance with sequential user input, the display section 7 allows the display 13 to display an event input screen such as a staff notation (score). Using the GUI capability, the display section 7 helps exactly input musical performance data such as musical notes (or simply notes) as follows. A data input portion can be zoomed in according to operations of the control key Kc. The mouse Ms can be used to move the cursor (CL) to an intended position to enter a musical note. The zoom-in magnification can be configured to a specified value (e.g., double) by default or to an intended value according to user operations (11).

The sound generating section 8 includes a sound source and an effect provision DSP. The sound generating section 8 generates musical sound signals corresponding to actual musical performance information based on musical performance operations on the musical performance operation section 12, musical performance information stored in storage section 3 and 4, musical performance data (for preview) processed during the score input process, and the like. A sound system 14 is connected to the sound generating section 8, comprises a D/A conversion, an amplifier, and a speaker, and generates musical sounds based on musical sound signals from the sound generating section 8. The sound generating section 8 and the sound system 14 constitute the musical sound output section.

The communication I/F 9 in FIG. 1 generically represents general communication networks such as a local area network (LAN), the Internet, and telephone lines, or other various interfaces connected to MIDI networks. The communication I/F 9 can interchange various information with various external devices Ed such as other computers including servers and MIDI devices.

When the apparatus does not store control programs or data, the apparatus can use the communication I/F 9 to download control programs and the like from the other computers Ed. Further, it is possible to input or output various musical performance information to the external device Ed using various MIDI devices including other musical performance information input apparatuses (such as keyboard instruments) and musical performance information output apparatuses.

[Event Input Screen]

The musical performance data creation system according to an embodiment of the present invention uses the display device to display a data input musical score called an "event input screen". When musical performance data is pasted on the musical score in accordance with user operations, the event input screen zooms up the vicinity of a musical performance event (music note) being dragged to widen at least ranges toward high pitches. The event input screen is designed to easily paste musical performance data parts (music notes) to intended pitch positions. FIG. 2 exemplifies the transition of event input screens simulating a staff notation (score).

With reference to FIG. 2, the following concisely describes points on musical performance data input in the musical performance data creation system according to the embodiment of the present invention. As a first user operation in the system, turning on the left click button Lb of the mouse Ms enables a position indication (pointing) using the cursor CL in a data input area DA. While keeping the left button turned on, further turning on the control key Kc as a second operation displays an enlarged input area LA on the data input area DA. The enlarged input area LA provides a partially zoomed-in view of the vicinity of the position pointed by the cursor CL. This area LA can also allow operations of the mouse Ms to move the cursor CL. As a third operation, turning off the left click button of the mouse Ms at an intended cursor position can input the system with a musical note corresponding to the cursor position as musical performance data. In this manner, the note position is determined. The system is provided with musical performance data having the timing and the pitch corresponding to the determined position, i.e., the pointed time position and pitch position.

With reference to FIG. 2, the following describes in more detail an example of entering musical performance data using the event input screen simulating the staff notation according to the embodiment of the present invention. In this example, the display 13 displays an event input screen SW based on the staff notation. Using this screen SW, a user can enter individual musical performance events.

The event input screen SW has a stationary display area at its left side. This area statically shows graphics representing clefs and staffs corresponding to musical performance parts, a key, a time, and the like corresponding to each part (track), the range, the key, and the time predetermined for musical performance data the user is going to create or edit. The stationary display area can display any performance part in accordance with operation of upward and downward scroll buttons (top and bottom triangle marks) at the right end of the screen SW. Further, operating a vertical scroll bar up and down can display graphics corresponding to any portion of the performance part. In addition, the stationary display area displays "TRACK 1" at the bottom as shown in FIG. 2 as the name of a performance part (track) being currently created (edited).

The right part of the event input screen is used as a data input area (also referred to as a score input area) DA for entering any musical performance data in accordance with user operations. To create new musical performance data, the data input area DA displays background graphics such as a staff and bar lines. To edit musical performance data, the data input area DA displays the other graphics such as already created musical performance data (notes, rests, and various music symbols in addition to the background graphics). The data input area DA can vertically scroll to display any part in response to operations of the upward and downward scroll buttons or the scroll bar at the right end of the screen SW. In addition, the data input area DA can display any time-based portion along the time axis left and right in response to operations of horizontal scroll buttons (left and right triangle marks) or a horizontal scroll bar at the bottom of the screen SW.

Along the horizontal direction (abscissa direction), the data input area DA is assigned with positions (hereafter referred to as "time positions") representing timings in accordance with the progress of musical performance. Along the vertical direction (ordinate direction) orthogonal to the horizontal direction, the data input area DA is assigned with positions (hereafter referred to as "sound type positions" or "pitch positions" corresponding to percussion sound types and pitches) in each part.

Along the horizontal axis (also referred to as a time axis), for example, there are displayed additional lines such as a bar line BL, a beat line (down) AL and a beat line (up) in different representations (shapes and colors). Above these lines, line symbols (numbers) are displayed as needed. These additional lines and line symbols function as time-oriented markers for pointing time positions of musical performance data the user is going to enter. Along the vertical axis (also referred to as a sound type axis or a pitch axis), there are arranged the staff as a staff notation's main object and a plurality of additional leger lines (indicated with broken lines above and below the staff) representing leger line positions. The display of the staff, the additional leger line, and the stationary display area on the left work as markers for pointing sound type positions or pitch positions for musical performance data the user is going to enter.

The data input area DA uses images of the staff, the additional leger line, and the additional lines BL and AL as background graphics. These images are called staff notation images or sore images including data images for already entered notes and rests.

When musical performance data is entered, the display 13 also displays a palette to specify musical performance data (musical notes, rests, and the like) types for specifying musical note types ranging from a dotted whole note to a thirty-second note and equivalent rest types. A user can selectively specify intended musical performance data types from the palette.

To enter musical performance data, the display (display apparatus) 13 shows the event input screen SW for a first part (track 1), i.e., a melody part (except the cursor CL and the musical note image) as shown in FIG. 2(1). Using the mouse Ms, the user moves the cursor CL to a position for selecting, e.g., "eighth note" as the musical note type from a musical note type specification palette (not shown). The user first turns on the left click button Lb of the mouse Ms (first operation).

This operation specifies the eighth note as musical performance data to be entered. The top part of the stationary display area shows that the user is going to enter an "eighth note" in terms of the note (musical note) type. The user can drag the mouse cursor CL into the data input area DA of the event input screen SW. The user can move the mouse cursor CL to any position in the data input area DA to specify (point) the note position. In this case, as shown in FIG. 2(1), moving the cursor CL synchronously moves a musical note image (generically referred to as a data image) representing the specified eighth note.

Dragging the cursor CL into the data input area DA enables a zoom-in function using the control key Kc. For example, let us consider that the cursor CL is positioned as shown in FIG. 2(1), i.e., the time position set to the third up-beat in the first bar and the pitch position set to "G3". In this case, the user, keeping the left click button turned on, further turns on the control key Kc (second operation). At this time, as shown in FIG. 2(2), the enlarged input area (enlarged input screen) LA is displayed. The enlarged input area LA provides a view that zooms up the staff notation (score) image around the position pointed by the cursor CL as well as the musical note image at a specified magnification. Moving the mouse Ms, the user can freely move the cursor CL in the enlarged input area LA.

When the cursor CL (i.e., the musical note image) is positioned to the display coordinate system in the enlarged input area LA, it is preferable to display the cursor so as to correspond to the cursor position on the data input area DA as shown in FIG. 2(2). In FIG. 2, for example, the cursor CL in the enlarged input area LA is placed at the time position set to the third up-beat in the first bar and the pitch position set to "G3". The additional line representing the third up-beat in the first bar and the second line representing "G3" in the enlarged input area LA are displayed so as to correspond to the additional line representing the third up-beat in the first bar and the second line representing "G3" in the data input area DA. While pointing the note position in the enlarged input area LA, the user can reference the equivalent markers such as additional lines and the staff in the data input area DA without exiting from the enlarged input area LA. The user can easily and accurately identify pointed positions on the staff notation.

It is preferable to sufficiently size the enlarged input area LA so as to approximately center the position (the tip of an arrow in FIG. 2 representing the cursor) of the cursor CL in the area and to display the whole of the data image (musical note image) representing the musical performance event.

Then, let us suppose that the user moves the cursor to an intended position in the enlarged input area LA and turns off the left click button Lb of the mouse Ms (third operation). The note data corresponding to the cursor position is input to the system. The enlarged input area LA disappears. For example, let us suppose that the user quickly turns off the left click at the position in FIG. 2(2). The musical note having the gate time equivalent to the eighth note is reliably input as the musical performance data that turns the note on at the timing of the third up-beat in the first bar with the pitch set to "G3". At this time, the enlarged input area LA disappears from the event input screen SW and return to the display state of FIG. 2(1). The musical note image is stationary (fixed). Moving the mouse Ms only enables the cursor CL to move. The user can confirm that the musical performance data is input to the intended position.

The musical performance data can be edited by changing the type or position of the already entered note. To do this, the user can once delete the note to be edited, and then perform the above-mentioned note input procedure. Depending on cases, however, it may not be necessary to use the musical note type specification palette.

For example, only the note position may need to be changed. To do this, the user positions the cursor CL to a note to be edited, and then turns on the left click button Lb of the mouse Ms. Keeping the left click button Lb turned on, the user moves the mouse Ms to move the cursor CL together with the note to an intended position, and then turn off the left click button Lb.

Also in this case, the user can display the enlarged input area LA by turning on the control key Kc while keeping the left click button Lb turned on. The user accurately positions the cursor CL in the enlarged input area LA, and then turn off the left click button Lb. In this manner, the corresponding node data can be reliably entered to the intended position.

FIG. 3 exemplifies the transition of event input screens simulating a piano roll. Like FIG. 2, FIG. 3 shows an example of the first performance part (track 1), i.e., the melody part. An event input screen RW of the piano roll type in FIG. 3 also allows input of musical performance data corresponding to a time position and a sound type or pitch position specified in the data input area DA. The enlarged input area LA is used to accurately position a note to newly enter or edit the musical performance data. This principle is basically the same as the event input screen of the staff notation type.

In particular, the data input area DA contains rows that represent pitches in units of semitones and are displayed in alternately differing patterns. These rows are called piano roll score images including the additional lines (BL, AL, and the like) and already input data images. Lengths along the time axis of bar images (data images) represent types of notes (musical notes) to be input (ranging from dotted whole notes to thirty-second notes). The cursor CL indicates the start point (note-on point) of a note. The stationary display area (left) shows an instrumental keyboard having keys corresponding to the rows of the piano roll score image. Specifically pitched keys (i.e., those with pitch names "C") are provided with pitch symbols (e.g., C2, C3, and the like) as needed. Each row's pattern and the instrumental keyboard indication serve as markers to point pitch positions.

Like the above-mentioned example, it is possible to enter musical performance data using the event input screen RW of the piano roll type in FIG. 3 as follows. The user moves the cursor CL to a position, for example, to select the musical note type "eighth note" from the musical note type specification palette. The user turns on the left click button Lb (first operation) of the mouse Ms to specify the eighth note as musical performance data to be input. The user then drags the bar image (the black portion in FIG. 3) as long as the eighth note together with the cursor CL into the data input area DA of the event input screen SW. The user can move the bar image to any position in the data input area DA to specify (pointing) the position of the note.

When dragging the cursor CL into the data input area DA, for example, the user keeps the left click button turning on at the position of the cursor CL in FIG. 3(1), i.e., the time position set to the third up-beat in the first bar and the pitch position set to "Bb2". The user then turns on the control key Kc (second operation). At this point, the enlarged input area LA as shown in FIG. 3(2) overlaps with the data input area DA. The enlarged input area LA zooms up the vicinity of the position pointed by the cursor CL together with the bar image. Manipulating the mouse Ms, the user can freely move the cursor CL in the enlarged area LA.

Also in this case as shown in FIG. 3(2), the cursor position in the enlarged input area LA is displayed so as to correspond to the cursor CL in the data input area DA, i.e., the time position set to the third up-beat in the first bar and the pitch position set to "Bb2". While pointing the note position in the enlarged input area LA, the user can reference the equivalent markers such as additional lines and the instrumental keyboard in the data input area DA without exiting from the enlarged input area LA. The user can easily and accurately identify the intended pointing position.

Then, let us suppose that the user moves the cursor to an intended position in the enlarged input area LA and turns off the left click button Lb of the mouse Ms (third operation). The note data corresponding to the cursor position is input to the system. For example, quickly turning off the left click at the position in FIG. 3(2) reliably inputs the eighth-note musical performance event that turns the note on at the timing of the third up-beat in the first bar with the pitch set to "Bb2".

The enlarged input area LA may be provided with supplementary information to confirm cursor positions. For example, as shown in FIG. 3(2), the cursor CL's position (arrow tip) may enable the end of the corresponding row to display a symbol (Bb2 in the example of FIG. 3(2)) indicative of the tone type (pitch) position corresponding to the pointed position. Further, specifically pitched rows may be always provided with the pitch symbol (C3 in the example of FIG. 3(2)).

[Operation Flow to Create Musical Performance Data]

Figure 4:
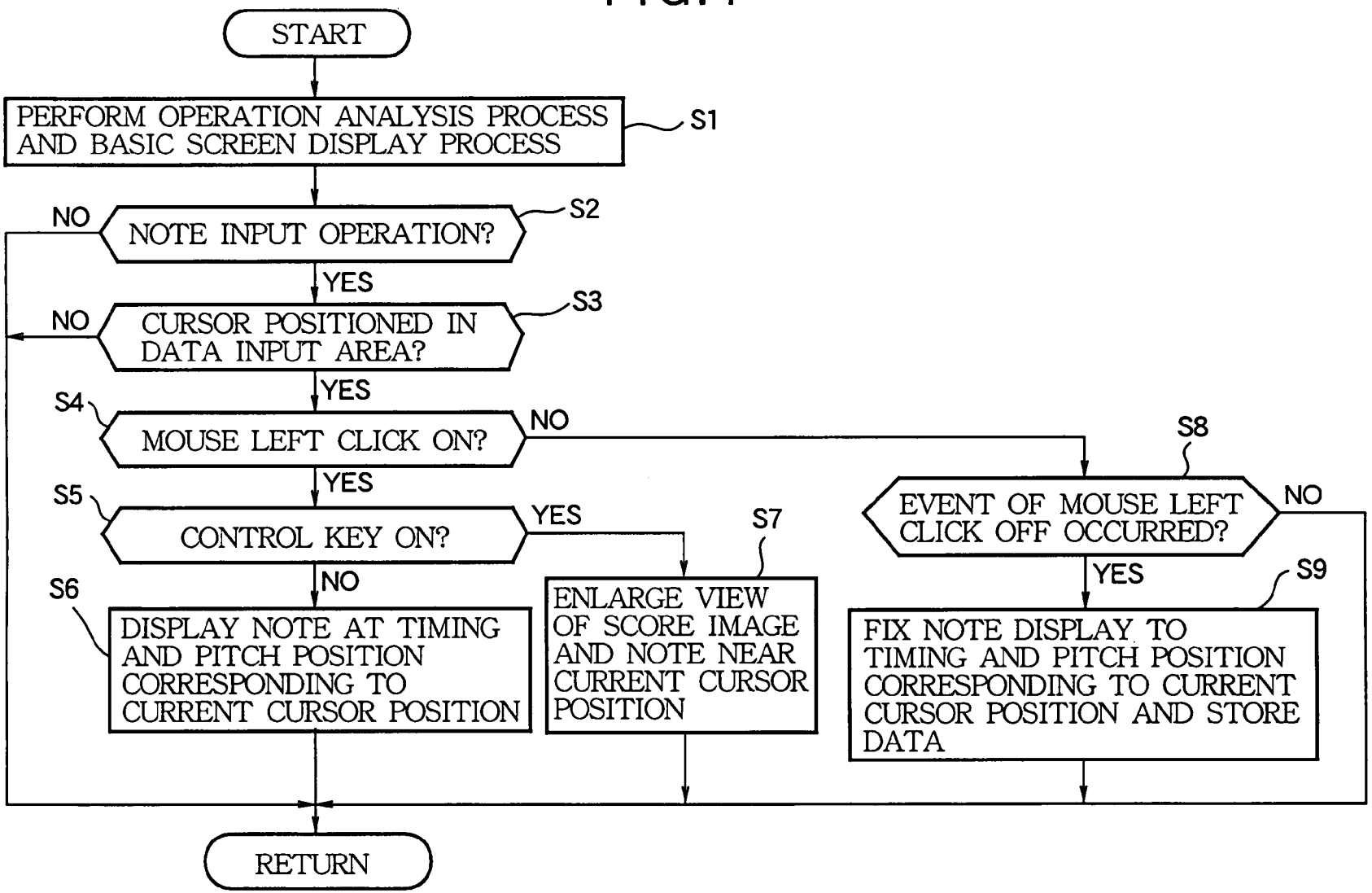
FIG. 4 is a flowchart exemplifying operations of the musical performance data input process ("score input process") according to the embodiment of the present invention.

The musical performance data creation system according to the embodiment of the present invention can execute a musical performance data input process called a "score input process" in accordance with a musical performance data creation program to create (or edit) musical performance data using the above-mentioned event input screens. FIG. 4 is a flowchart exemplifying the musical performance data input process according to the embodiment of the present invention. The operation flow is initiated by a specified timer interrupt or a user-specified interrupt.

When the operation flow in FIG. 4 starts, the system first executes an operation analysis process and a basic screen display process at step S1 to analyze the contents of key and mouse operations. In accordance with setup conditions on the panel operation section 11, for example, the system allows the display 13 to display the event input screens SW and RW having the data input area DA as shown in FIGS. 2 and 3.

At step S2, the system determines whether or not there occurs a user operation concerning note input. The user operation includes operating the left click button Lb of the mouse Ms, moving the mouse Ms, and operating the control key Kc. When it is determined that the above-mentioned user operation does not occur (NO at step S2), the system immediately returns. When it is determined that there occurs a user operation concerning note input (YES at S2), the system proceeds to S3 to determine whether or not the cursor CL is positioned in the data input area DA.

When it is determined at step S3 that the cursor CL is not positioned in the data input area DA, the system performs a specified process and then returns to the original process step. Such specified process includes, for example, specifying a musical note type (e.g., an eighth note) to be an input candidate when the cursor CL is positioned so as to specify the musical note (e.g., the eighth note) in a musical performance data type specification palette (not shown) and the mouse Ms causes an event to turn on the left click button Lb (turn-on operation). According to the input candidate specification process, the stationary display area can display the corresponding musical note. Further, keeping the left click turned on, moving the mouse can drag the musical note image corresponding to the musical note type (FIG. 2) or the bar image (FIG. 3) together with the cursor CL into the data input area DA.

On the other hand, when the cursor CL is positioned in the data input area DA (YES at S3), it is determined at step S4 whether or not the left click button Lb is turned on. When the left click button Lb is turned on (YES at S4), the system further proceeds to step S5 and determines whether or not the control key Kc is turned on.

When the control key Kc is not turned on, i.e., the left click of the mouse Ms remains turned on, the system proceeds to step S6. The system performs a process to display a note image for the specified musical note type (e.g., an eighth note) at the time position and the pitch position corresponding to the cursor CL's current position. The system then returns to the original process step.

When the control key Kc is turned on (YES at S5), the system proceeds to step S7. The system displays an enlarged view of the score image and the note image (FIG. 2) or the piano roll score image and the bar image (FIG. 3) near the cursor CL's current position. That is, the system performs a process to display the enlarged input area LA on the data input area DA as shown in FIG. 2(2) or 3(2), and then returns to the original process step. Due to this display process, the user can move the mouse while turning on the left click to easily position the note in the enlarged input area LA using the cursor CL.

When it is determined at step S4 that the left click button Lb of the mouse Ms is not turned on, the system determines at step S8 whether or not an event occurs to turn off the left click button Lb of the mouse Ms (turn-off operation).

When it is determined that an event occurs to turn off the left click button Lb of the mouse Ms (YES at step S8), the system proceeds to step S9 to remove the enlarged input area LA. The system fixes (drops) the display of the note at the time position and the pitch position on the data input area DA corresponding to the cursor CL's current position. The system uses the RAM 2 to store the musical performance data as the note event corresponding to the time position and the pitch position and then returns to the original process step.

When no event occurs to turn off the left click button Lb (NO at S8), the system performs a necessary process and then returns to the original process step. An example of such process takes place as follows. Let us assume that the cursor CL is positioned to the note already fixed in the data input area DA and an event occurs to turn on the left click button Lb of the mouse Ms (turn-on operation). Under this condition, the system performs a process to specify that note to be an edit candidate. The stationary display area displays the corresponding musical note type. In addition, the data input area DA or the enlarged input area LA enables the note's play position together with the cursor CL to be moved (dragged).

According to the embodiment as mentioned above, turning on and off the left click button Lb of the mouse Ms drags and drops the musical performance data image of a specified type. Meantime, merely inserting an operation of turning on the control key Kc provides an effect of simply and easily enabling accurate positioning of musical performance data by using the partially zoomed in enlarged input area LA.

[Various Modes]

While there has been described the preferred embodiment of the present invention, the invention can be embodied in various modes. According to the embodiment, for example, the first and third operations are assigned to operations of turning on and off the left click button on the mouse tool. The second operation is assigned to the control key. These operations may be assigned to other panel operation devices.

According to the embodiment, the control key operation provides a simple zoom-in operation. Further, changing the number of control key operations may stepwise provide zoom-in operations (to sequentially increase the magnification each time the control key is operated). A second control may be provided to resume the original display of the data input area or reduce the magnification in accordance with operations after the zoom-in operation. The size of the enlarged input area (LA) may or may not change in accordance with zoom-in magnifications.

In addition, the resolution of mouse operations may be increased while the enlarged input area (LA) is displayed and the mouse is concurrently used to drag move objects such as a musical note and a note bar (a bar indicating an event on the piano roll and the like) so that the objects can move more finely than the normal state (where the enlarged input area is not displayed) in response to the mouse movement distance. In this manner, a user can easily determine a position to enter data in the enlarged input area (LA).

As described above, in the musical performance data creation system according to the present invention, the musical performance data input screen (SW, RW) on the display (13) is provided with the data input area (DA) such as a score notation or a piano roll. A user operates a mouse (Ms) and the like to input musical performance data corresponding to the position (CL) pointed in the data input area (DA). The first user operation (Lb turned on) enables pointing of the position (CL) corresponding to the musical performance data to be input. When the second user operation (Kc) occurs (YES at S5) thereafter, the system displays (S7) the enlarged input area (LA) that enlarges (zooms up) the vicinity of the specified position (CL). When the third user operation (Lb turned off) occurs (YES at S8), the system inputs (S9) the musical performance data corresponding to the position pointed in the enlarged input area (LA).

For example, an intended note (musical note) can be input by means of pointing operations based on operations of turning on and off the left click button (Lb) of the mouse (Ms). In this case, when the user turns on (first user operation) the left click button (Lb), the system enables pointing of a play position in the data input area (DA) by means of the mouse cursor (CL). Operating the mouse (Ms) can move pointing positions. When the user turns off (third user operation) the left click button (Lb) at an intended position, the system determines the pointing position and enables a musical note corresponding to the position to be input. In this case, the user can turn on the left click (first user operation) and then turn on (second user operation) the control key (Kc) to enlarge (zoom up) the vicinity of the pointed position. Manipulating the mouse (Ms), the user can accurately move the cursor (CL) in the enlarged area (LA) to the position representing the intended timing (time) and pitch. When the user turns off (third user operation) the left click at the intended position, the pointing position is determined. The system is inputted with the intended note (musical performance data) having the timing and the pitch corresponding to the determined position (i.e., pointed time position and pitch position).

In this manner, the present invention partially enlarges the vicinity of the pointed position in the data input area correspondingly to the specific operation (second user operation) in a series of pointing operations. It is possible to accurately and easily write musical performance data corresponding to a target position.

This musical performance data creation system, for example, simulates the staff notation or the piano roll in the data input area (DA) defined by two-dimensional coordinates system. Accordingly, musical performance data can be input based on time positions representing musical performance timings along a specified direction (e.g., the abscissa) and based on positions corresponding to pitches or percussion sound types along another specified direction (e.g., the ordinate) orthogonal to the specified direction. Stated otherwise, a pair of two-dimensional coordinates of the position specify a musical timing and a musical pitch/sound type, respectively, of the musical note arranged at the position, and the inventive system inputs the musical performance data representing the musical timing and the musical pitch/sound type of the musical note.

In this case, with respect to the two-dimensional coordinates system, it is preferable to display the time position and the sound type/pitch position (CL) specified in the enlarged input area (LA) so as to coincide with either of the time position or the sound type/pitch position (CL) specified in the data input area (DA). Consequently, when pointing a musical performance data position in the enlarged input area, the user can reference a marker in the data input area for the position corresponding to the enlarged input area. The user can easily and reliably identify the pointed position.

What is claimed is:

1. An apparatus for creating musical performance data according to operations of a user, comprising:

a screen display section that displays an input screen having a data input area for inputting musical performance data, the input screen simulating a staff notation;

a position indication section operable when a first operation is taken by the user for indicating a position on the data input area;

a display enlargement section operable when a second operation is taken eventually by the user for enlarging a local portion of the data input area around the indicated position and displaying the enlarged local portion over the data input area such that the enlarged local portion provides a zoomed view of the staff notation around the indicated position, thereby allowing the user to take a supplemental first operation on the enlarged local portion more easily than the first operation such that the position indication section responds to the supplemental first operation for indicating a position on the enlarged local portion of the data input area; and a data input section that is responsive to a third operation of the user for inputting musical performance data corresponding to the position indicated according to the first operation when the supplemental first operation is not taken by the user, or corresponding to the position indicated according to the supplemental first operation when the supplemental first operation is eventually taken by the user.

2. The apparatus according to claim 1, wherein the display enlargement section superposes the enlarged local portion over the data input area, such that the position indicated in the enlarged local portion is in alignment with the position indicated in the data input area.

3. The apparatus according to claim 1, wherein the screen display section displays the input screen having the data input area defined by two-dimensional coordinates system, the position indication section indicates the position where a musical note is to be arranged such that a pair of two-dimensional coordinates of the position specify a musical timing and a musical pitch, respectively, of the musical note arranged at the position, and the data input section inputs the musical performance data representing the musical timing and the musical pitch of the musical note.

4. A computer-readable medium storing a computer program for controlling an apparatus having a processor and a display to create musical performance data according to operations of a user, the program including instructions for:

displaying an input screen having a data input area for inputting musical performance data, the input screen simulating a staff notation;

indicating a position on the data input area when a first operation is taken by the user;

enlarging a local portion of the data input area around the indicated position when a second operation is taken by the user such that the enlarged local portion provides a zoomed view of the staff notation around the indicated position;

displaying the enlarged local portion over the data input area, thereby allowing the user to take a supplemental first operation on the enlarged local portion more easily than the first operation such that a position is indicated on the enlarged local portion of the data input area according to the supplemental first operation; and responding to a third operation taken by the user for inputting musical performance data corresponding to the position indicated by the first operation when the supplemental first operation is not taken by the user, or corresponding to the position indicated by the supplemental first operation when the supplemental first operation is taken by the user.

* * * * *